United States Patent [19]

Lee

[11] 4,071,965

[45] Feb. 7, 1978

[54] PIVOTED EJECTOR WITH HINGED DOOR FOR EARTHMOVING SCRAPERS

[75] Inventor: Emil B. Lee, Morton, Ill.

[73] Assignee: Caterpillar Tractor Co., Peoria, Ill.

[21] Appl. No.: 572,247

[22] Filed: Apr. 28, 1975

[51] Int. Cl.[2] ..... E02F 3/82

[52] U.S. Cl. ..... 37/4; 37/8; 37/126 AC; 37/126 AE; 37/129

[58] Field of Search ..... 37/124, 126, 128, 129, 37/132, 133, 4, 8, 9, 126 R, 126 A, 126 AE, 126 AC; 294/69 R; 298/29, 30

[56] References Cited

U.S. PATENT DOCUMENTS

| | | | |
|---|---|---|---|
| 1,982,219 | 11/1934 | McAlister | 37/133 X |
| 2,607,137 | 8/1952 | Kunneman | 37/133 |
| 2,791,044 | 5/1957 | Hancock | 37/126 A |
| 3,108,388 | 10/1963 | Johnson | 37/126 AC |
| 3,208,165 | 9/1965 | Johnson et al. | 37/8 |
| 3,328,903 | 7/1967 | Campbell et al. | 37/129 |
| 3,343,286 | 9/1967 | Ray, Jr. et al. | 37/129 X |
| 3,431,663 | 3/1969 | Eiger | 37/126 R |
| 3,452,458 | 7/1969 | Campbell et al. | 37/126 R X |
| 3,646,693 | 3/1972 | Simmons | 37/124 X |
| 3,651,589 | 3/1972 | Reynolds | 37/126 AA X |
| 3,680,234 | 8/1972 | Scott | 37/126 AC X |
| 3,732,637 | 5/1973 | Whitworth | 37/129 X |
| 3,934,362 | 1/1976 | Hyler | 37/8 |

FOREIGN PATENT DOCUMENTS

| | | | |
|---|---|---|---|
| 556,910 | 7/1923 | France | 37/133 |

*Primary Examiner*—Edgar S. Burr
*Assistant Examiner*—Steven A. Bratlie
*Attorney, Agent, or Firm*—Wegner, Stellman, McCord, Wiles & Wood

[57] ABSTRACT

A self-loading elevating scraper is provided with a dumping or ejector mechanism for quickly and efficiently expelling the entire contents of the scraper bowl. The bowl is provided with a pivoted floor or platform and a hinged floor or platform which platforms are interconnected by links. A power source, such as a hydraulic cylinder, is mounted on the scraper and engages with one of said links such that actuation of the cylinder pivots both the pivoted floor or platform and the hinged floor or platform out of soil supporting relationship thereby permitting the soil to drop from the bowl.

3 Claims, 2 Drawing Figures

PIVOTED EJECTOR WITH HINGED DOOR FOR EARTHMOVING SCRAPERS

BACKGROUND OF THE INVENTION

1. Field of the Invention

This invention relates to earthmoving equipment and, more particularly, to a self-loading earthmoving scraper with an ejector bottom.

2. Description of the Prior Art

Earthmoving equipment of the scraper type has been known for some time and has been used extensively on every conceivable type of project. After the bowl on the scraper has been filled with soil, the scraper is moved to a location where the soil is to be dumped and spread. Many different mechanisms have been devised for dumping the load where and when desired.

One of the principal difficulties faced by designers of the dumping mechanisms is the fact that a heavy load of soil is stacked on top of the floor or platform of the bowl which floor or platform must be moved in some way to permit the soil to drop from the bowl. In the Simmons et al. U.S. Pat. No. 3,564,737, a pair of floor plates are hinged together and at the same time a slidable third floor plate is located adjacent thereto. To dump the load, the hinge ends of the pair of plates are forced up into the load in the bowl as the third plate slides into a position beneath the upwardly hinged plates. Since the hinged ends of the plates meet the full resistance of the load, considerable force is required to operate the dumping mechanism.

Another solution to the problem is shown in the Campbell et al. U.S. Pat. No. 3,452,458 wherein the floor of the bowl is pivoted up along one wall of the bowl as the load spills down out of the bowl when the floor moves out of supporting relationship. Although this mechanism operates satisfactorily, the dumping mechanism must again overcome a considerable downwardly directed force to initiate dumping of the load.

SUMMARY OF THE INVENTION

A scraper is provided with a two-part dump mechanism which facilitates starting and completing the dumping process. The mechanism has a hinged platform and a pivoted platform which platforms combine to form the support bottom for the contents of the bowl. Actuators are connected to each platform and are pivoted to each other with a linear power source drivingly connected to one of said actuators. Linear movement from the power source aided by the weight of the load on the hinged platform will drop the one end of the hinged platform and, along with it the soil piled immediately thereon. Simultaneously, the pivoted platform will pivot about its mounting and out from beneath the soil thereby dumping the soil from the bowl.

The hinged platform, upon dropping partially under the weight of the load in the bowl and partially from the movement of the power source, commences dumping the center of the load which loosens the packing in the load making the continued movement of the hinged and pivoted platforms easier. Since the whole bottom of the bowl is open, once the two platforms are moved out of supporting position, the likelihood of material hanging up or staying in the bowl is minimized.

BRIEF DESCRIPTION OF THE DRAWINGS

The details of construction and operation of the invention are more fully described with reference to the accompanying drawings which form a part hereof and in which like reference numerals refer to like parts throughout.

In the drawings.

DESCRIPTION OF THE PREFERRED EMBODIMENT

Figure 1:
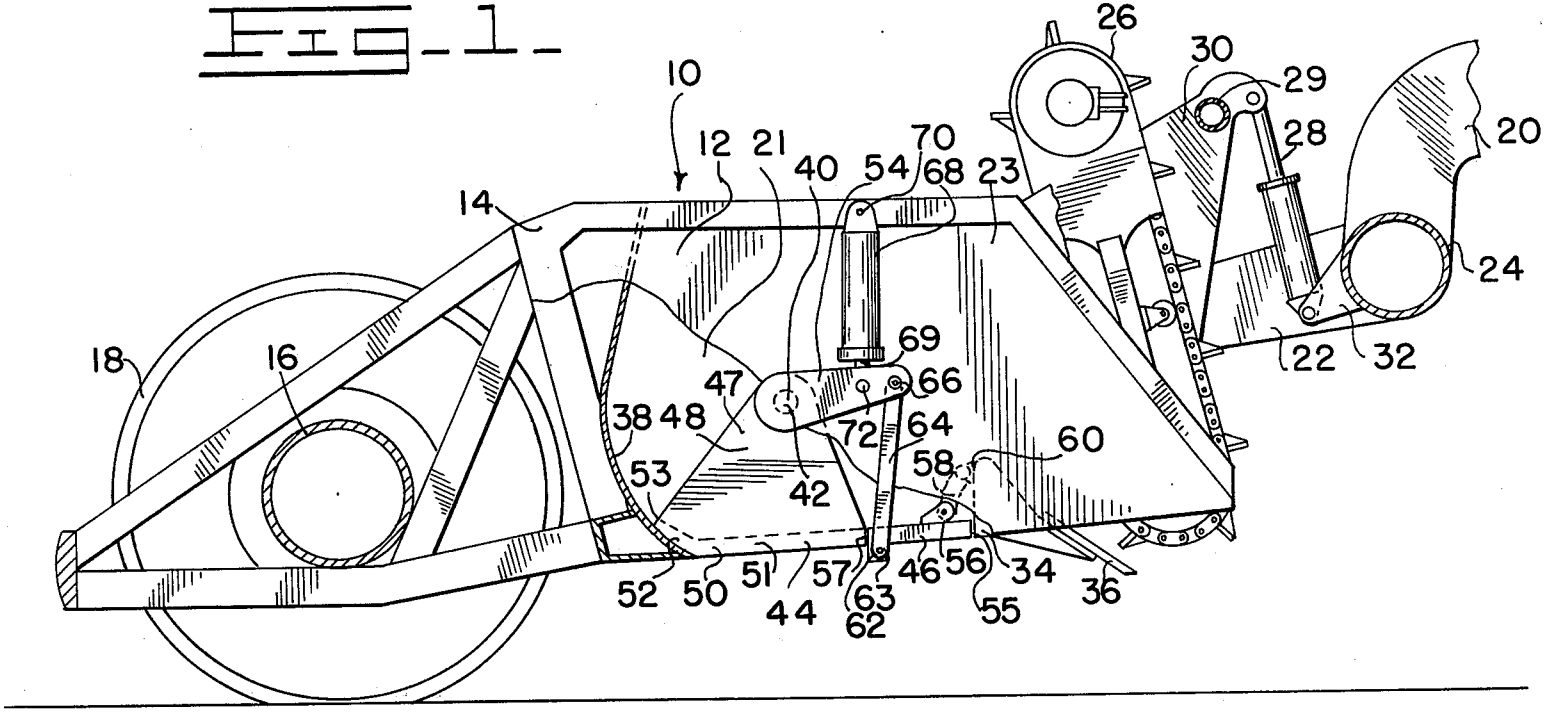
FIG. 1 is a side elevation view, partially in section, of a self-loading scraper having the load ejector or dumping structure of the present invention in load supporting position.

Referring to the drawings, and in particular to FIG. 1 thereof, a self-loading elevator scraper 10 is provided with a bowl assembly 12 mounted on a draft frame 14 which in turn is supported on an axle 16 upon which a pair of rear wheels 18 is rotatably mounted. The scraper 10 may be propelled over the terrain by any one of the well known means and, as shown, is drawn by a tractor (not shown) through a gooseneck 20 which is connected to the draft arms 22 pivotally mounted on the side walls 21,23 of the bowl. The forward ends of the draft arms 22 are attached together by a spreader bar 24 with the gooseneck 20 being connected to the midportion of said spreader bar 24. Jacks 28 extend between the outer ends of extension plates 30 carried by the bowl 12 and links 32 fastened to the spreader bar 24 thereby providing vertical control for the forward part of the scraper. A support bar 29 extends between the extension plates 30 to add rigidity to said plates. A chain and flight elevator 26 is operatively mounted at the front of the bowl 12 for loading soil into the bowl.

Fastened between the side walls 21,23 of the bowl 12, slightly rearward of the elevator 26, is the cutting blade support 34 to which is fastened a cutting blade 36 along the lower forward edge thereof. The blade 36 projects forwardly and downwardly from the bowl to cut away a layer of soil and together with the support 34 guides the soil into the bowl 12.

Improved means and mechanisms are provided for supporting the soil in the bowl and to facilitate dumping the soil from the bowl when desired. Specifically, the rear wall 38 of the bowl is formed in a slightly concave or curved shape which concavity or curvature lies generally along a surface generated by a radius about a point 40 which point lies on the axis of a pair of sidewardly projecting pins 42. The base or bottom of the bowl is comprised of two separate sections or platforms, one being a pivoted platform 44 and the other being a hinged platform 46. The platforms 44 and 46, when in closed position, mate with each other in such a way as to form the floor or bottom for the bowl 12 and lie in a common, substantially horizontal plane having a longitudinal axis extending perpendicular to the cutting blade support 34. The pivoted platform 44 has a pair of generally triangularly-shaped side walls 47,48 which walls are secured to the pivot pins 42 at the apex of said triangularly shaped walls. The bases of the triangular side walls 47,48 are interconnected side-to-side by a floor portion 50, which throughout a front portion 51 of its longitudinal length is substantially flat and which has an angled rear portion 52 projecting rearwardly and upwardly therefrom. The rear portion 52 tapers in thickness from its juncture with portion 51 to an outer edge 53 which faces and somewhat mates with the lower segment of the arcuately curved rear wall 38 of the bowl. With the pivoted platform 44 in closed position, the rear portion 52 overlaps with the wall 38 and the front portion 51 spans the width of the bowl to hold the contents of the bowl therewithin. The pair of pivot pins 42 project through openings in the side walls 21,23, respectively, of the bowl and are fixedly attached to the links 54 which are positioned parallel to the outer surfaces of the side walls.

The hinged platform 46 consists of a flat, straight portion extending substantially between the inside of the side walls 21,23 and has a forward edge 55 lying in close proximity to the rear edge of the cutting blade support 34 with the rearward edge 57 lying parallel to and close to the forward edge of the pivoted platform 44. The hinged platform 46 has a pair of spaced apart lugs 56 secured to the top surface thereof. The lugs 56 are pivotally connected by means of a pair of short arcuately shaped links 58 to a pair of spaced apart lugs 60 carried on the rearward face of the support 34. The axis passing through the pivots between the lugs 56 and links 58 is located forward of the side-to-side center line of said hinged platform 46 so that the weight of soil on the platform 46 tends to pivot the platform counterclockwise, as viewed in FIG. 1, which tends to bring link 64 down with it. A plane containing the pivots 42 for the platform 44 lies parallel to the horizontal plane of the platforms 44,46, when in the closed position, and is spaced from said horizontal plane a distance several orders of magnitude greater than the distance between said horizontal plane and the plane containing the pivot axis passing through the pivots between the lugs 60 and the lower end portions of links 58. A pair of projections 62 extend downwardly from the bottom rear portion of said hinged platform 46 with the outer surface of said projections 62 extending beyond the plane of the outer surface of the side walls of the bowl 12. The link 64 is pivotally connected at 63 to the projections 62 exteriorly of the side walls of the bowl 12. The other ends of the links 64 are pivotally connected to the forward ends of the links 54 so that the two links 64,54 on each side of the bowl are capable of moving relative to each other about a pivot pin 66 passing through both of said links.

A power source, such as a hydraulic cylinder 68, is connected to each side of the bowl 12 exteriorly of the side walls thereof with the one end of each hydraulic cylinder being connected by a pivot pin 70 to the frame 14 and with the extendable end 69 of the cylinder being pivotally connected by means of a pivot pin 72 to the intermediate portion of the link 54. Each pivot pin 72 is spaced from the pivot pin 66 an amount less than the spacing of the pivot pin 72 from the pivot pin 42. As shown, the distance from pin 72 to pin 66 is approximately one-half the distance from the pin 72 to the pin 42. The ratio of these distances can vary depending upon the amount of relative movement intended between the pivoted platform 44 and the hinged platform 46.

Figure 2:
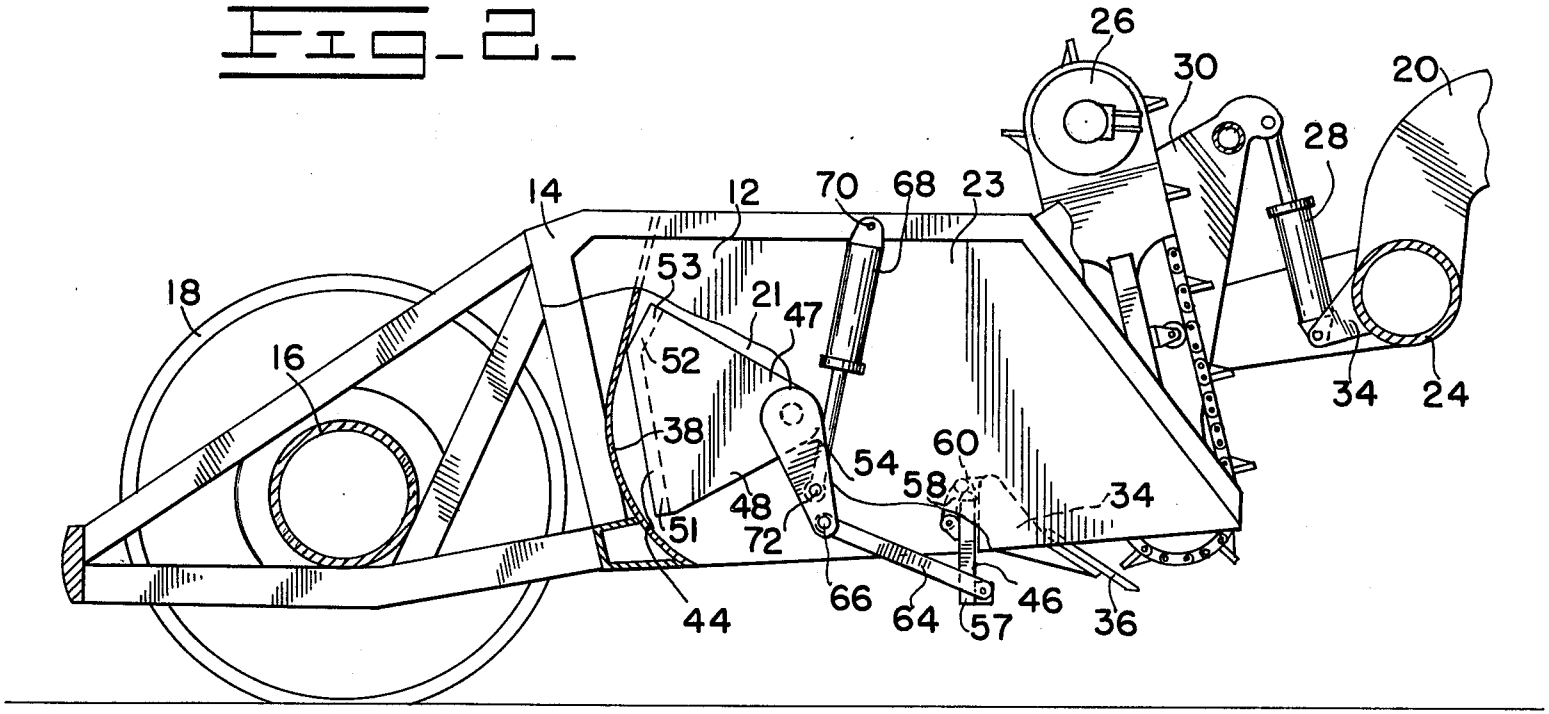
FIG. 2 is a side elevation view of the scraper of FIG. 1 only with the load ejector or dumping structure in load dumping position.

Upon actuation of the hydraulic cylinders 68, the links 54 will be pivoted about the axis of the pins 42 passing through the side walls 21,23 whereupon the pivoted platform 44 will be rotated clockwise from the closed position of FIG. 1 to the open position of FIG. 2. Simultaneously, the links 64 will be lowered moving the hinged platform 46 about the end of the link 58 so as to hinge the platform 46 about the pivots at each end of the link 58 so as to drop the platform 46 and pivot it out of the way of the falling material in the bowl. The hinged platform 46 moves to a vertical orientation lying parallel to and immediately behind the support 34. In this way, all of the material originally supported by the pivoted platform 44 and the hinged platform 46 will be dumped or dropped out the bottom of the bowl of the scraper. Upon reactivation of the cylinder 68, the pivoted platform 44 and the hinged platform 46 will be returned to the bottom-forming position shown in FIG. 1 whereupon continued forward movement of the scraper with the forward end portion of the bowl lowered, another layer of soil will be scraped up by the cutter blades 36 which soil will be elevated by the elevator 26 into the bowl 12 and onto the supporting surfaces 51,52 of the pivoted platform 44 and onto the supporting surface of the hinged platform 46.

The pivoted platform 44 is pivoted about the pins 42 and subscribes a substantially arcuate path in conformance with the arcuate shape of the rear wall 38 of the bowl. Since it is a pure pivoting motion and since material is being dumped as it begins to move, the resistance to pivoting of the platform is reduced. The rear leading edge 53 of the angled floor portion 52, is narrow and acts almost as a scraper in cutting through the material that lies in its path along the arcuate curved wall 38 of the bowl 12. In this way, resistance to the pivoting of the pivoted platform 44 is reduced. The hinged platform 46, since it is dropped down and pivoted out of the way of the falling material, has the weight of the dirt or soil as a helping influence in dropping down out of the way of the falling material. Once again, since the weight of the material on the platform 46 acts through the link 64 to the link 54, the weight of the material on the platform 46 will also assist in pivoting the pivoted platform 44 out of the supporting position shown in FIG. 1. In this way, the weight of the material, instead of resisting opening the platforms for dumping of the materials, serves to assist said dumping function.

What is claimed is:

1. In a self-loading scraper having a frame, a bowl supported on said frame and having spaced side walls defining an open front and an open bottom, a cutting blade extending between said side walls and carried on said bowl forward of said open bottom, wheels on said frame, means for raising and lowering the forward part of said bowl to engage or disengage said cutting blade with a layer of soil and a movable bottom on said bowl covering said open bottom and being movable to an open position to dump the soil collected in said bowl, said bottom comprising a first platform and a second platform which platforms when aligned in the closed position lie in a common substantially horizontal plane, means mounting the first platform such that the weight of a portion of the contents in the bowl bearing on said first platform aids in moving both the first and second platforms from the closed to the open position, said means comprising first pivot means carried by the bowl and being connected to said first platform at a forward location on said first platform, said first pivot means being located in a horizontal plane spaced a short distance above said common substantially horizontal plane, whereby said first platform is pivotally mounted offcenter, second pivot means carried by said bowl and being connected to said second platform, said second pivot means being located in a horizontal plane spaced above said common substantially horizontal plane a distance several orders of magnitude greater than the distance between said common substantially horizontal plane and said horizontal plane containing said first pivot means, first link means pivotally connected to said first platform at a rearward location on said first platform, said location of said pivotal connection of said first link means being remote from said first pivot means on said first platform and on the opposite side of the midportion of the first platform from said first pivot means, second link means fixedly attached to said second platform in the vicinity of said second pivot means, said first and second link means being pivotally connected together, and power means mounted on the frame and connected to said second link means whereby actuation of said power means creates a force on the links which when added to the force created by the weight of a portion of the contents of the bowl bearing on the offcenter mounted first platform is sufficient to pivot the first link and first platform downward and out of supporting relationship with said portion of the contents and simultaneously pivot the second link means and the second platform about the second pivot means to pivot the second platform in an arcuate path out of supporting relationship with the remaining contents of the bowl.

2. In a scraper as claimed in claim 1 wherein said bowl has a cutting blade support for supporting said cutting blade, said support being mounted between the side walls of the bowl, and said first pivot means comprises a lug mounted on a forward location on said first platform, a short link having one end portion pivoted to said lug and having the other end portion pivoted to a lug on said cutting blade support so that an evenly distributed load on said first platform will tend to urge a rearward portion of said first platform downward about the axis of said first pivot means connection to said first platform.

3. A scraper as claimed in claim 1 wherein said power means is a hydraulic cylinder mounted at one end on said frame and at the other end at an intermediate point on said second link means.

* * * * *